United States Patent [19]

Lacy

[11] 4,397,353

[45] Aug. 9, 1983

[54] METHOD FOR VERTICAL FRACTURE GROWTH CONTROL

[76] Inventor: James P. Lacy, Box 3309, Midland, Tex. 79702

[21] Appl. No.: 387,325

[22] Filed: Jun. 11, 1982

[51] Int. Cl.[3] ..... E21B 33/138; E21B 43/267

[52] U.S. Cl. ..... 166/281; 166/269; 166/280; 166/292

[58] Field of Search ..... 166/269, 292, 280, 281, 166/271, 307, 308, 312

[56] References Cited

U.S. PATENT DOCUMENTS

| | | | |
|---|---|---|---|
| 2,259,429 | 10/1941 | Simmons | 166/307 |
| 2,524,933 | 10/1950 | Silverman | 73/152 |
| 2,869,642 | 1/1959 | McKay et al. | 166/280 X |
| 3,013,607 | 12/1961 | Bond et al. . | |
| 3,126,056 | 3/1964 | Harrell | 166/281 X |
| 3,155,159 | 11/1964 | McGuire, Jr. et al. | 166/281 X |
| 3,241,613 | 3/1966 | Kern | 166/292 X |
| 3,280,912 | 10/1966 | Sheffield, Jr. | 166/292 X |
| 3,335,797 | 8/1967 | Braunlich, Jr. | 166/280 |
| 3,347,316 | 10/1967 | Havenaar | 166/292 |
| 3,371,715 | 3/1968 | Fly et al. . | |
| 3,372,752 | 3/1968 | Prater | 166/280 |
| 3,380,522 | 4/1968 | Payne, Jr. et al. | 166/292 X |
| 3,547,196 | 12/1970 | Closmann | 166/281 |
| 3,602,308 | 8/1971 | Vincent | 166/281 |
| 3,713,489 | 1/1973 | Fast et al. | 166/292 |

FOREIGN PATENT DOCUMENTS

| | | | |
|---|---|---|---|
| 153051 | 11/1959 | U.S.S.R. | 166/308 |

*Primary Examiner*—Stephen J. Novosad
*Assistant Examiner*—George A. Suchfield
*Attorney, Agent, or Firm*—Marcus L. Bates

[57] ABSTRACT

A process by which vertical fracture growth is controlled downhole in a hydrocarbon producing formation through which a wellbore extends. The wellbore includes a perforated casing. Two different fluids are simultaneously forced along two separate flow paths downhole into the borehole, with the first flow path entering the uppermost perforations and the second flow path entering the lowermost perforations of the perforated casing. The first flow path conducts acid laden with relatively coarse grains of sand into the hydrocarbon producing part of the formation, while the second flow path conducts the flow of water laden with relatively fine grains of sand into the water producing part of the formation. The flow characteristics of the water/sand mixture and the acid/sand mixture causes the fine sand to drop out along the water/oil interface located between the low water and high water part of the formation. This action forms a barrier which forces the acid/sand solution to be forced out into and remain in the low water strata, where the formation is fractured, propped open by the relatively coarse grains of sand, and acidized. This process therefore treats the hydrocarbon containing part of the formation, rather than losing the treatment fluid into the high water part of the formation.

17 Claims, 3 Drawing Figures

METHOD FOR VERTICAL FRACTURE GROWTH CONTROL

BACKGROUND OF THE INVENTION

There are many instances where a wellbore has been formed down through a payzone and satisfactory production realized for a substantial length of time. However, as time progresses, for one reason or another, the well commences making excess water while the hydrocarbon production diminishes. In this instance, the formation surrounding the perforations is comprised of a low water strata, which is the hydrocarbon production part of the formation, and a high water strata, which accounts for most of the water produced by the well. The low water and high water strata meet or contact one another along an interface. Usually the low water, oil bearing strata is located above the high water strata.

In order to increase the hydrocarbon production of the above described wellbore, acidizing and fracturing is often attempted; however, the acid along with the propping agent flows along the path of least resistance, which is usually into the high water strata where the acid probably does more harm than good. When a marginal well, such as the one described above, fails to respond to this type of well stimulation, it is usually thought best to abandon the well because of the economics involved.

It would be desirable to be able to force acid and propping agents into the hydrocarbon producing part of the formation, where the formation can be fractured and acid treated; and, the fractures propped open with suitable propping agents, thereby increasing the production of the wellbore. It would be desirable to be able to form a barrier along the water/oil interface between the low water and high water strata, thereby enabling the acid treatment to be carried out and effected on the hydrocarbon producing part of the formation in contrast to the water producing part of the formation. Such a desirable method is the subject of the present invention.

SUMMARY OF THE INVENTION

This invention relates to a method of improving the oil/water ratio produced by a hydrocarbon producing well, wherein the wellbore is cased and perforated, and extends through a formation having a low water strata and a high water strata which meet along a water/oil interface adjacent to the perforations of the casing.

The method is carried out by forming a first flow path which extends from the surface of the ground, down to the uppermost ones of the perforations; so that a first treatment agent can be forced along a flow path down into the borehole and into the low water strata of the formation.

A second flow path is formed from the surface of the ground down to the lowermost ones of the perforations, so that a second treatment chemical can flow along a flow path down to the high water part of the formation.

The first and second treatment fluids are simultaneously pumped downhole into the perforated zone, with the first treatment fluid preferably flowing down the annulus and the second treatment fluid flowing down a tubing string.

The lower end of the tubing string is placed below the lowermost perforations so that fluid flow into the lowermost perforations is preferred by the fluid mechanics of the system.

The first treatment fluid includes any desired fracturing fluid, such as cross-link gel and water, for example, and a suitable propping agent, such as relatively coarse grains of sand, for example. The second treatment fluid preferably is water admixed with a barrier forming material, such as relatively fine grains of sand; for example. Hence, the first treatment fluid is often a high grade material and the second treatment fluid is often a low grade material.

The water laden with relatively fine sand flows down the tubing string and into the lowermost perforations, where the sand laden water continues to flow predominantly along the interface formed between the low water and high water strata. The sand is deposited as a layer or blanket as it flows radially away from the well. The sand laden water follows the path of least resistance, which is also the supply source of the unwanted produced water.

Simultaneously, the fracturing material laden with the propant material is pumped down the annulus, and this fluid also follows the path of least resistance. However, the pressure gradient of the two flowing streams and the blanket of sand which has commenced building up and forming a barrier along the low and high water interface forces the fracturing material to preferentially enter the uppermost ones of the perforations and flow out into the hydrocarbon producing part of the formation, which is also the low water strata.

The fine sand continues to be laid down as a blanket, while the fracturing material is continuously pumped into the upper perforations, and consequently, the low water strata is fractured, and propped open, with there being very little of the high grade material lost into the high water strata.

Production is resumed, and since the well has been properly stimulated, flow will occur from the new, improved, propped open fractures, into the perforations, and uphole to the surface of the ground, with there being increased hydrocarbon production and decreased water production.

Therefore, a primary object of the present invention is the provision of a method for fracturing an isolated part of a formation located downhole in a borehole.

Another object of the present invention is the provision of a method of controlling the vertical fracture growth of a hydrocarbon producing formation located downhole in a borehole.

A still further object of the present invention is the provision of a method by which a low and high water strata of a formation located downhole in a borehole can be separated one from another so that treatment fluid can preferentially be forced into one of the selected strata.

Another and still further object of the present invention is the provision of a method of treating a hydrocarbon producing formation located downhole in a borehole by simultaneously pumping two different treatment fluids along two different isolated flow paths so that one treatment fluid is forced into the uppermost perforations of the borehole and into the hydrocarbon producing formation while the other treatment fluid is forced into the lowermost perforations and into a lower part of the formation.

An additional object of the present invention is the provision of a method by which a low water formation is separated from an adjacent high water formation by simultaneously pumping two different treatment fluids along two different flow paths so that one of the treatment fluids forms a barrier between the high water formation and the low water formation, while the other treatment fluid acidizes, fractures, and props open the hydrocarbon producing low water formation.

These and other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

DETAILED DESCRIPTION OF THE PREFERRED EMBODIMENTS

Figure 1:
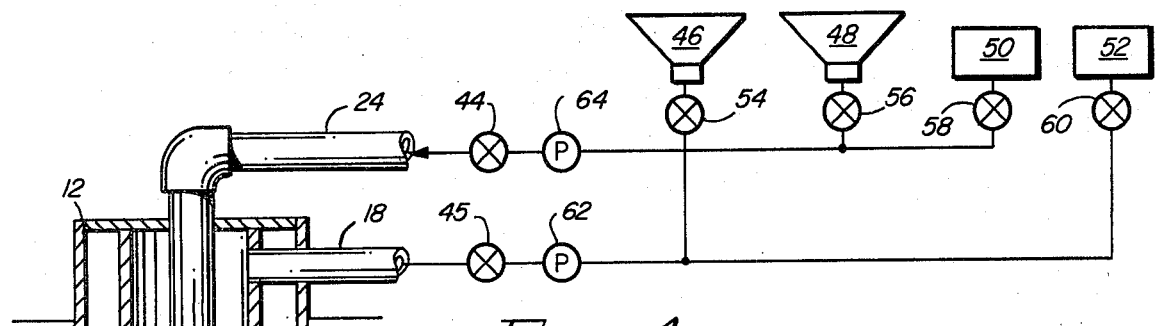
FIG. 1 is a part diagrammatical, part schematical, longitudinal, cross-sectional representation of a strata of the earth having a borehole formed therein, with the present invention being schematically illustrated in conjunction therewith.

FIG. 1 of the drawings diagrammatically illustrates an oil well 10 having the usual wellhead 12. The wellbore extends downhole and includes the usual casing 16. Lateral pipe 18 is connected to conduct flow from the casing annulus. The lower end 20 of the casing is located at the bottom of the wellbore 14.

A tubing string 22 extends along the longitudinal axial centerline of the casing, and is connected to a lateral outlet 24 at the upper end thereof, and terminates at lower end 26, thereby leaving a rat hole therebelow.

The casing and tubing string form an annular area 28 therebetween, which broadly is termed the upper annular area 30 and the lower annular area 32. Numeral 34 indicates the interior casing wall. The casing is perforated in the usual manner, and includes uppermost perforations 36, lowermost perforations 38 and intermediate perforations 40. The perforations may extend over a considerable length of the casing.

The interior wall surface 42 of the tubing string provides an isolated flow path from valve 44, through lateral pipe 24, down through the tubing string, and out of the lower terminal end 26 thereof.

A suitable propping agent, such as relatively coarse sand, is contained within hopper 46; while a suitable barrier forming material, such as relatively fine sand, is contained within hopper 48. Water or oil is contained within vessel 50, while acid or fracturing fluid is contained within vessel 52.

The sand at 46 can instead be any suitable propping agent, such as, for example, glass beads, aluminum shot, crushed walnut shells, and 10–20 mesh grains of sand. The sand at 48 is any suitable, inexpensive substance which can be admixed with and caused to flow along with the carrier fluid 50 when admixed therewith, as for example, 100 mesh grains of sand.

The water at 50 may be any inexpensive liquid substance which can be pumped downhole in accordance with the present invention, as for example, salt or fresh water or crude oil.

The substance at 52 preferably is a cross-link gel and water, oil, or any other fracturing fluid which is suitable for fracturing a hydrocarbon containing formation located downhole in a borehole.

Hence, the substance contained within hopper 46 and vessel 52, when admixed, is termed "a high grade material", and, the substance contained within hopper 48 and vessel 50, when admixed, is termed "a low grade material" because of the relative fracturing quality of the material.

Valves 54, 56, 58, and 60, respectively; control the flow of material from containers 46, 48, 50 and 52, respectively. Pump 62 forces a mixture of sand and liquid through valve 45 and into the lateral piping 18, while pump 64 forces a mixture of material from containers 48 and 50 through valve 44 and into piping 24. In actual practice, the hoppers have an outlet connected to a blender or sand proportioner located downstream of the liquid vessels 50 and 52.

The hydrocarbon producing formation includes strata 66 and 68 which are located downhole several hundred or thousand feet below the surface of the ground, and are communicated with the interior of the casing by means of the before mentioned perforations. Strata 66 is a low water portion of a hydrocarbon containing formation while strata 68 is a high water portion of a hydrocarbon containing formation. High water is present in the formation 66, 68; and, the hydrocarbons and water meet along interface 70 with the oil being on the upper side of the interface and the water being on the lower side of the interface as indicated in the figures of the drawings. In actual practice, there is no sharp interface 70 which divides the formation into strata 66 and 68, but instead there is usually a gradient of the water/oil which downwardly increases, with line 70 being a theoretical medium.

Numerals 72, 74, 76, and 78 broadly indicate treatment areas formed within four radial fractures, within which a layer of the low grade material has formed a barrier. Numeral 80 indicates a mixture of the high and low grade treatment chemicals where the pressure gradient allows the two materials to meet, thereby causing a limited amount of mixing between the two.

More specifically, numeral 72 indicates a vertical fracture which extends vertically uphole and downhole an indeterminate length above and below the interface 70, and radiates from the casing in one or more directions, in a manner suggested by the diagrammatical illustration of FIG. 2 as noted by numerals 72, 74, 76, and 78. Many people erroneously assume that a fractured formation lies horizontally and extends 360° circumferentially about the casing and radiates 100–300 feet from the casing. Others skilled in the art of downhole formation believe that the fractured formation is generally vertically oriented as noted in FIG. 1 by numeral 72; and, in FIG. 2 by numerals 72, 76, or 74, 78. Most engineers believe that only two fractures 72, 76 exist.

Figure 2:
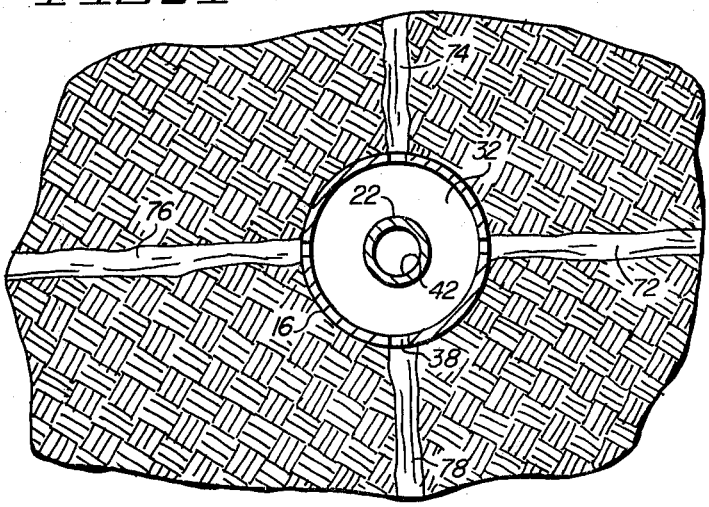
FIG. 2 is a cross-sectional view taken along line 2—2 of FIG. 1; and, FIG. 3 is an enlarged, fragmentary representation of part of the borehole seen illustrated in FIG. 1.
Figure 3:
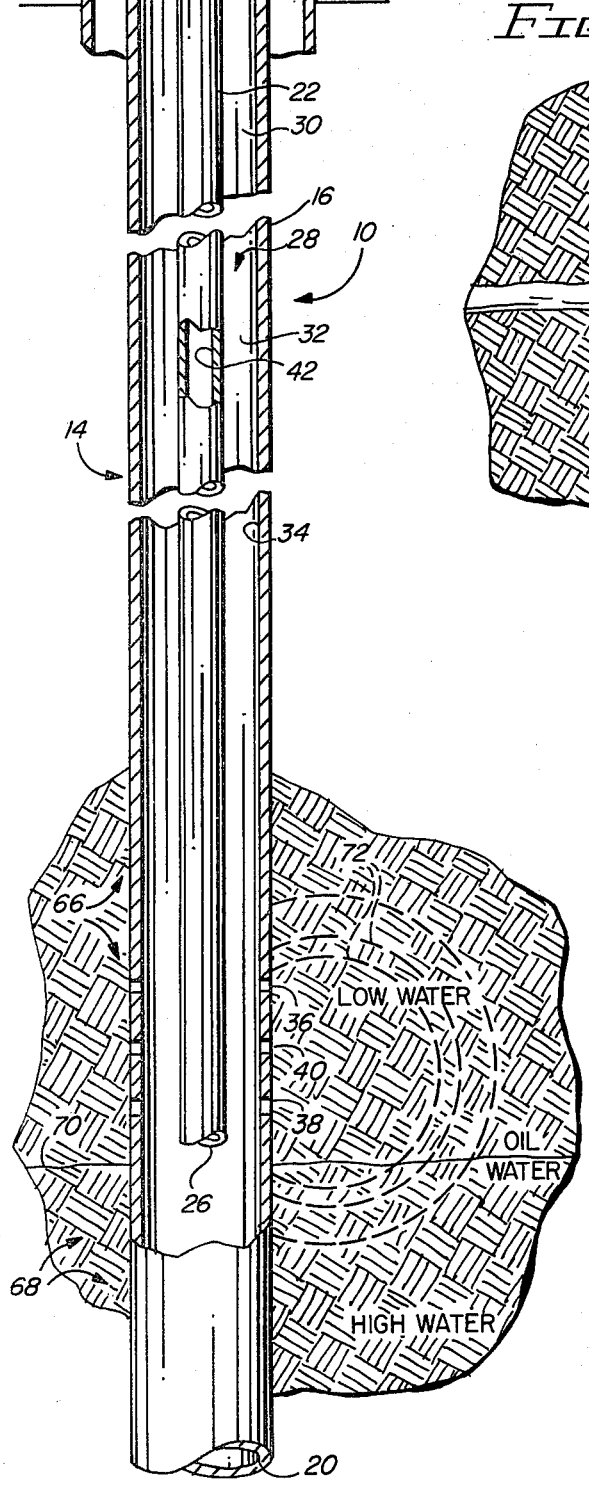
Figure 3:
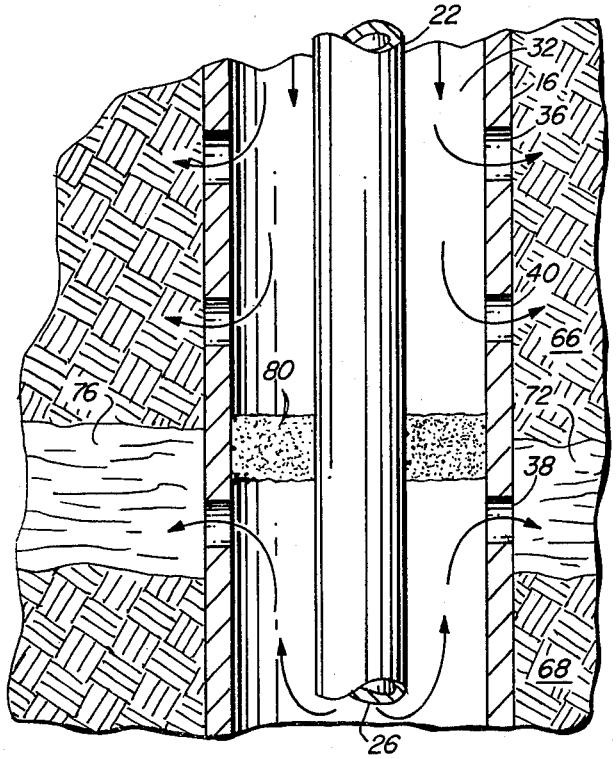

Numerals 72, 76 of FIGS. 2 and 3 broadly indicate a barrier of the small grain sand which has been formed along the oil/water interface 70 of FIG. 1, and which prevent flow from the upper perforations from entering the high water formation, and thereby enables the vertical growth of the fracture to be controlled in accordance with the present invention.

In carrying out the present invention, trucks containing pumps, hoppers, and tanks, are arranged at the wellhead to simultaneously pump the high grade and low grade fluids along separate or isolated flow paths down through the perforations and into the formation. The first treatment fluid, comprised of the high grade material, is pumped at 62 through valve 45, lateral pipe 18, annulus 30, 32 and into the uppermost perforations 36. At the same time, the low grade fluid is pumped at 64 through valve 44, into the lateral pipe 24, down the tubing 22, through the end 26 and through the lowermost perforations 38. The low grade fluid, comprised of water or oil and relatively fine sand, flows through the lowermost perforations 38 and travels along the path of least resistance. Since the low grade fluid is entering the formation fracture at the lowest perforations and has a low viscosity, the fine sand falls to the lower leading edge of the fracture thereby forming a barrier to the downward growth of the fracture system.

As seen in FIG. 3, the low grade fluid exits end 26 of the tubing string and flows back up the lower annulus where the low grade fluid meets the high grade fluid within annulus 32, so that the high grade fluid predominantly flows through the uppermost perforations, the low grade fluid predominantly flows through the lowermost perforations 38, with there being some mixing 80 between the high grade and low grade fluids.

As the low grade fluid is forced to flow out along one of the vertical fractures 72, 76 or 74, 78, as seen in FIG. 2, the relatively fine sand is deposited along the flow path as indicated by numerals 72, 76 in FIG. 3.

The blanket of fine sand is progressively laid down at 72–78 along the interface 70 of the vertical fractures 72–78 and forms a barrier which precludes flow from the low water into the high water strata. The dynamic flowing characteristics of the system of the present invention therefore comprehends two competing zones 66, 68 each thirsting for the flows from 26 and 32, with the flow along 32 being directed into the low water strata and the flow from 28 being directed into the high water strata because of the blanket of sand being laid down along the interface 70, as well as the pressure distribution effected between the flowing high grade and low grade fluids. The present invention enables fracturing and acidizing of the low water formation to be preferentially carried out in the low water area, which is also the payzone. The relatively coarse propping agent enters and props open the fractured formation; and, the barrier 72–76 retards subsequent water production from the high water strata after the well treatment has been completed.

The relative flow rates at pumps 62 and 64 determine the relative rate with which treatment fluid enters the two stratas 66 and 68. For example, assume for the purpose of discussion that there are five perforations 36–40, that three barrels/minute low grade material is pumped at 64 and seven barrels/minute high grade material is pumped at 62. It can further be assumed that the perforations are all open and each accepts the same rate of flow therethrough. Under these conditions, it is evident that the three barrels/minute low grade material will enter the lowest perforation and that the seven barrels/minute will enter the remaining upper four perforations. The pressure at the surface must be adjusted at 44, 45 to achieve this relative flow rate.

Example 1. Five thousand gallons of potassium chloride admixed with four pounds of 100 mesh sand per gallon, was used as the low grade treatment fluid and pumped downhole through the tubing string at a rate of two barrels per minute. At the same time, 20,000 gallons of cross-linked ineued water, or treating fluid, containing two pounds of 10–20 mesh sand per gallon was used as the high grade treatment fluid and pumped down the annulus at an initial rate of six barrels per minute. The high grade and low grade material was simultaneously pumped downhole, where the low grade material deposited a barrier which permitted all of the treating fluid to preferentially flow into the strata 66.

Each of the treatment fluids was followed by the calculated amount of fresh water required to displace the material from the tubing and annulus. The well was shut in for 12 hours and thereafter produced.

The present invention provides for a method of treating a well wherein treatment chemical flows through the lower perforations to lay down a barrier which prevents the downward growth of the fracture. The high grade fluid fractures the formation and the props open the fractures caused by the high pressure, high grade fluid. The high grade fluid can be acid so that fracturing and acidizing and propping open of the formation simultaneously occurs. The present invention prevents the acid from being lost into the high water strata as well as directing the fracturing process upwardly into the low water strata.

The present invention enables fracturing and acidizing to be carried out without losing the fracturing material into the high water part of a formation, but instead, forces all of the fracturing or acidizing material into the low water part of the formation; which is the oil producer, or the best part of the payzone; thereby controlling the growth of the fracture so that the fracture extends up into the low water strata rather than downwardly into the high water strata.

In another example, water was admixed with sand having grains 20–100 mesh size. The mixture was pumped down the tubing and used as the low grade treatment fluid. Oil admixed with 10–20 size grains of sand was pumped down the annulus as the high grade treatment fluid.

The fine grains of sand were deposited at the lower leading edge of the fracture formed between the low and high water strata, and thereby formed a barrier which prevented the downward growth of the fracture, and which also prevented loss of the oil into the high water portion of the strata. The oil admixed with the relatively large grains of sand was forced out into the low water portion of the payzone where fracturing occurred and the large grains of sand acted as a propping agent which propped open the fractures.

The high grade material can be water, oil, or dilute acid along with a suitable propping agent. The low grade material can be any inexpensive carrier fluid, including fresh or salt water admixed with a barrier forming substance, such as fine grains of sand.

Some boreholes penetrate water and oil producing stratas in a manner which requires the control of the upward growth of the fracture. In this instance, the relationship of the flow lines at 62 and 64 is reversed so that the high grade material is pumped down the tubing string and into the lower perforations, while the low grade material is pumped through the annulus and into the upper perforations, thereby controlling the upward growth of the fracturing process.

The term "low grade material" sometimes becomes a misnomer when the cost thereof exceeds the cost of the high grade material.

The present invention can be used to advantage where a dual packer is employed. The outlet of one tubing is placed below the perforations while the outlet of the other tubing is placed above the perforations. The low grade treatment fluid is pumped down the tubing string located below the perforations while the high grade fluid is pumped down the tubing string located above the perforations.

The present invention isolates one strata from another to thereby enable treatment to be effected upon a selected part of a formation. The treatment fluid effected on the low water part of the formation can be limited to acidizing the strata, or fracturing the strata, or both acidizing and fracturing the strata.

I claim:

1. In a cased borehole which extends downhole through a hydrocarbon producing formation, and which has been perforated adjacent said formation, the method of reducing the amount of water produced from the borehole comprising the steps of:

(1) forming a first flow path from the surface of the ground down to the uppermost perforations;

(2) forming a second flow path from the surface of the ground down to the lowermost perforations;

(3) selecting a first treatment fluid which includes a relatively coarse material suitable for a propant agent;

(4) selecting a second treatment fluid which includes water and a relatively fine material;

(5) simultaneously flowing said first treatment fluid along said first flow path and said second treatment fluid along said second flow path so that the upper perforations receive the first treatment fluid and the lower perforations receive the second treatment fluid; thereby forming a barrier with said fine material which causes the first treatment fluid to be predominantly contained within the upper part of the formation.

2. The method of claim 1 wherein the treatment fluid of step (3) is selected from the group consisting of oil, hydrochloric acid, and water; while the propant agent is coarse sand of less than 20 mesh, and the fine material of step (4) is relatively fine sand.

3. The method of claim 1 wherein the first fluid enters the upper perforations and fractures, acidizes, and props open the formations while the second fluid enters the lower perforations where the fine material of the second fluid deposits within the formation and forms a barrier which prevents the first fluid from entering the lower part of the formation.

4. The method of claim 1 wherein most of the relative coarse material is larger than 20 mesh and most of the relative fine material is less than 100 mesh.

5. The method of claim 1 wherein step (3) includes dilute hydrochloric acid and relatively coarse sand while step (4) includes relatively fine sand;

the first fluid enters the upper formations and fractures, acidizes, and props open the formation; while the fine material of the second fluid deposits within the formation and forms a barrier which prevents the first fluid from entering the lower part of the formation;

the relative coarse material is larger than 20 mesh and the relative fine material is less than 100 mesh.

6. In a cased borehole extending down through a hydrocarbon producing formation which has an upper low water strata and a lower high water strata which meet along an oil/water interface adjacent the casing perforations, the method of treating the formation comprising the steps of:

(1) pumping a carrier fluid laden with relatively fine grains of material down a tubing string and into the lower perforations, while at the same time;

(2) pumping a fracturing fluid laden with relatively coarse grains of material down the casing annulus and into the upper perforations;

(3) continuing to simultaneously carry out steps (1) and (2) so that the carrier laden with relatively fine material forms a barrier between the upper low water strata and the lower high water strata; and, (4) the fracturing fluid laden with relatively coarse material is forced to flow into and fracture the low water strata, while the relatively coarse material enters the fractured zone and props open the formation.

7. The method of claim 6 wherein said fine grains of material is sand which is mostly 100 mesh and larger, while said coarse grains of material is sand which is mostly 20 mesh and larger.

8. The method of claim 6 wherein dilute hydrochloric acid is used to clean out the perforations prior to forcing the fracturing fluid down into the formation.

9. The method of claim 6 wherein said fine material includes grains of sand which are mostly 100 mesh and larger, while said coarse material includes grains of sand which are mostly 20 mesh and larger.

10. The method of claim 9 wherein step (1) includes NaCL and KCL admixed therewith.

11. In a borehole which extends downhole through a production zone; wherein the production zone includes a low water strata which produces hydrocarbons, and a high water strata which produces water, the method of isolating one strata from the other and treating one of the stratas with a treatment chemical comprising the steps of:

(1) simultaneously pumping a first treatment chemical and a second treatment chemical along separate flow paths downhole into the borehole;

(2) conducting said first treatment chemical into the low water strata;

(3) conducting said second treatment chemical into the high water strata;

(4) said second treatment chemical is a carrier fluid having barrier forming material therein which drops out to form a barrier between the high and low water strata so that the first treatment chemical is directed into the low water strata.

12. The method of claim 11 wherein the first treatment chemical is dilute acid which acidizes the low water strata.

13. The method of claim 11 wherein the first treatment chemical includes fracturing fluid and propants for fracturing and propping open the formation.

14. The method of claim 11 wherein the second treatment fluid is water and sand.

15. The method of claim 11 wherein the first treatment chemical is dilute acid which acidizes the low water strata;

wherein the second treatment fluid is water and sand.

16. The method of claim 11 wherein the first treatment chemical includes fracturing fluid and propants for fracturing and propping open the formation;

wherein the second treatment fluid is water and sand.

17. The method of claim 11 wherein the first treatment chemical includes fracturing fluid and propants suitably mixed together for fracturing and propping open the fractured formation;

and wherein the second treatment fluid is salt water suitably admixed with said barrier forming material.

* * * * *